US007739820B2

(12) United States Patent
Frank

(10) Patent No.: US 7,739,820 B2
(45) Date of Patent: Jun. 22, 2010

(54) BOOK SHELF DISPLAY DEVICE

(76) Inventor: Gary Liebling Frank, 2679 15th Ave., San Francisco, CA (US) 94127

( * ) Notice: Subject to any disclaimer, the term of this patent is extended or adjusted under 35 U.S.C. 154(b) by 0 days.

(21) Appl. No.: 12/154,752

(22) Filed: May 27, 2008

(65) Prior Publication Data

US 2008/0295376 A1 Dec. 4, 2008

Related U.S. Application Data

(60) Provisional application No. 60/932,407, filed on May 31, 2007.

(51) Int. Cl.

| | |
|---|---|
| ***G09F 3/20*** | (2006.01) |
| ***G09F 3/18*** | (2006.01) |
| ***G09F 3/16*** | (2006.01) |
| ***G09F 3/08*** | (2006.01) |
| ***G09F 7/18*** | (2006.01) |
| ***A45F 5/00*** | (2006.01) |

(52) U.S. Cl. ..... 40/647; 40/661.03; 40/666; 40/667; 40/658; 248/229.1; 248/229.13; 248/228.4; 248/231.51; 24/3.11

(58) Field of Classification Search ..... 40/647, 40/666, 67, 658, 661.03; 248/229.1, 229.13, 248/228.4, 231.51; 24/3.11

See application file for complete search history.

(56) References Cited

U.S. PATENT DOCUMENTS

| | | | | |
|---|---|---|---|---|
| 1,763,778 | A * | 6/1930 | Hanney | 40/666 |
| D293,489 | S | 12/1987 | Franzino | |
| D356,339 | S | 3/1995 | Geborek | |
| 5,441,228 | A | 8/1995 | Geborek | |
| 5,845,889 | A * | 12/1998 | Suzuki | 248/451 |
| 7,316,089 | B2 * | 1/2008 | Brinkman | 40/642.02 |
| D579,984 | S * | 11/2008 | Bruegmann et al. | D20/43 |
| 2002/0035768 | A1 * | 3/2002 | Gaetke | 24/563 |

* cited by examiner

*Primary Examiner*—Lesley Morris
*Assistant Examiner*—Syed A Islam
(74) *Attorney, Agent, or Firm*—Lawrence Edelman, Attorney at Law

(57) ABSTRACT

A spring loaded display device is described particularly suited for attachment to the leading edge of a shelf such as a bookshelf, the display unit including a clip mechanism for securely grasping the top and bottom surfaces of a shelf at its edge, the clip mechanism hingedly connected to a display unit which can freely rotate about the hinged connection. The display unit itself, generally of rectangular configuration, is designed to receive a document, and includes a transparent face so that the document contents may be easily viewed.

9 Claims, 3 Drawing Sheets

BOOK SHELF DISPLAY DEVICE

This application claims priority to my Provisional Application U.S. 60/932,407, filed May 31, 2007, and entitled Book Shelf Display Device.

BACKGROUND OF THE INVENTION

1. Field of the Invention

This invention relates generally to display devices, and more particularly to a combined spring loaded clip and display tag especially suitable for use with commercial book store shelves.

2. Description of the Related Art

In bookstores, it is often desired to highlight a particular shelved book by providing printed information about that book in the form of an associated card, tag or label. Ideally, the printed material is best positioned at or near the situs of the book on the shelf. Presently available are shelf tabs usually made out of plastic and including a clear plastic display portion into which a document can be placed and the tab press fitted to the edge of the bookshelf. Because of the need to allow books from a shelf below to be freely pulled from their location, display portion of the tab is size limited, in that it can not be so large as to interfere with removal of a book from a shelf below. Further, because these tab units are generally molded as a single piece, and thus necessarily of fixed dimension, different sized tabs are required for bookshelves of different thickness.

SUMMARY OF THE INVENTION

By way of the present invention, a display device designed for use with a book shelf is provided which includes a display portion hingedly mounted to a spring loaded clip. The display portion is generally made of transparent plastic, and includes front and back walls, closely spaced from each other to permit the insertion of a document such as a card, tag or label therebetween. The clip to which the display portion is attached comprises two interlocking pieces, in one embodiment formed from a metal material, with a spring mechanism biased to hold the pieces together in a closed position.

When positioning the display device/unit at a book shelf location, the dual clamshell like clamping members of the clip can be spaced apart such that the flat faces of each clamping member are brought into generally parallel opposition, the opening defined between the parallel faces slightly larger than the thickness of the book shelf itself. In this configuration the clip is easily mounted to the bookshelf when the pressure on the ends of the clip is released to permit the faces of the clamping members to grasp the end of the shelf. Soft rubber-like pads mounted to the inside faces of the clamping members at their leading edge make direct contact with the shelf and serve to improve the friction fit of the display unit, and thus restrain movement of the display device, once placed in position. One advantage provided by the clip mechanism employed with this invention is the ability for the display device to be used with a variety of bookshelves despite some variation in book shelf thickness.

With the display device mounted onto a bookshelf, the hinged display portion hangs freely in a generally perpendicular direction relative to the horizontal alignment of the book shelf. Being hinged and freely moveable, the display portion easily rotates out of the way from the vertical towards the horizontal to accommodate the removal of a book positioned on a bookshelf directly below and laterally in line with the display unit.

In one embodiment, the rear wall of the display portion is of reduced dimension relative to the front wall of the display portion so as to provide limited access to a document which has been inserted between the walls. In this manner one is able to more easily remove (or insert) the document from the display portion of the device.

BRIEF DESCRIPTION OF THE DRAWINGS

So that the above-recited features of the present invention can be understood in detail, a more particular description of the invention, briefly summarized above is set forth in the below description, and may be had by reference to various embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE INVENTION

Figure 1:
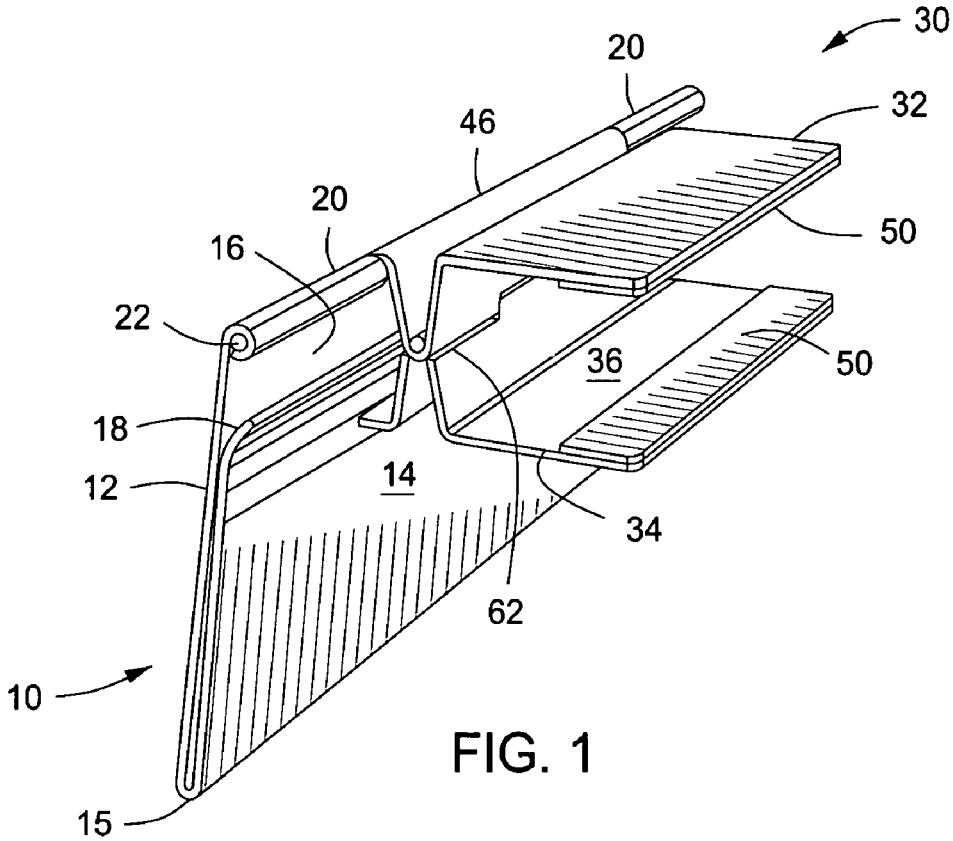
FIG. 1 is a rear perspective view of the spring loaded bookshelf device with pendant document display portion, the clip of said device shown in the open, shelf engaged position.
Figure 2:
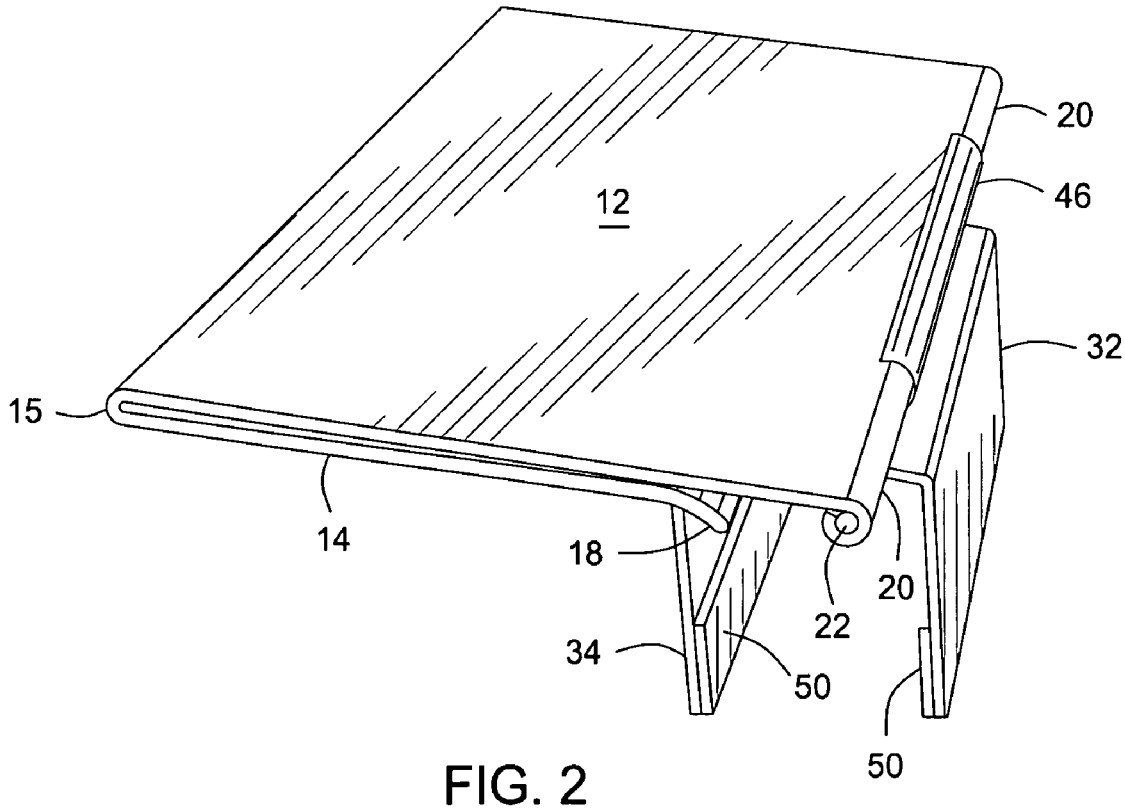
FIG. 2 is a front perspective view of the book shelf display device of FIG. 1.

Referring to FIG. 1 and FIG. 2, the display unit of this invention generally includes a display portion 10 hingedly mounted to a spring loaded clip portion or mechanism 30. Display portion 10 comprises front wall or face 12 and rear wall 14. Front face 12 is generally provided in one embodiment as a flat rectangular piece of transparent plastic, such as to render visible the graphic contents (written, printed or otherwise) of the card, tag or label to be placed behind face 12. Rear wall 14 likewise comprises a flat rectangular section sized along its length to match the length of front face 12. Together the two walls form a pocket for holding a document therebetween.

In one embodiment display portion 10 is molded as a singular piece, rear wall 14 folded back at bend 15, and angled forward such that wall 14 at its leading edge 18 is in contact with rear surface 16 of front face 12. In one embodiment, leading edge 18 can be fluted as shown in the figures to permit its grasping and pulling away from contacting surface 16, to thus facilitate insertion of a document behind face 12. Once released, the pressure of wall 14 against the inserted document further serves to fix the document in place. Similarly, fluted edge 18 may be likewise grasped and displaced to facilitate removal of a document already in place behind face 12.

Notably, the height of rear wall 14 is less than the height of front face 12. The height of rear wall 14 relative to front face 12 is not critical. However, the differential should be sufficient to allow one inserting or removing a card or the like from the display portion to be able to easily access the back surface of the document, thus facilitating the sliding by pushing of the document in to or out from between the opposing walls of display portion 10.

Likewise the type of plastic used to form the display portion is not critical. Important is that the plastic be transparent (though it may also be lightly tinted) so that the graphics of the inserted document are easily readable. In addition, the selected plastic should be sufficiently pliable such that limited movement of rear wall 14 away from surface 16 of front face 12 is permitted. Yet, repeated flexing of wall 14 away from face 12 should not cause fatigue and fracture of the plastic at bend 15.

Figure 3:
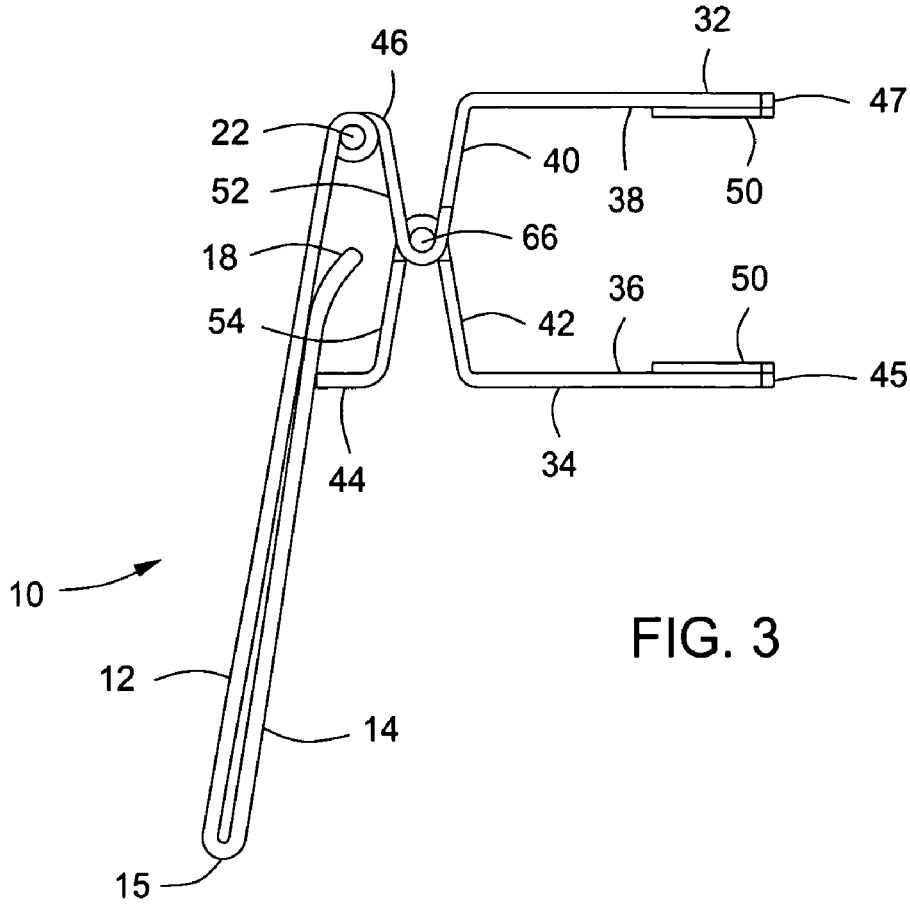
FIG. 3 is a side elevational view of the book shelf display device of FIG. 1.
Figure 4:
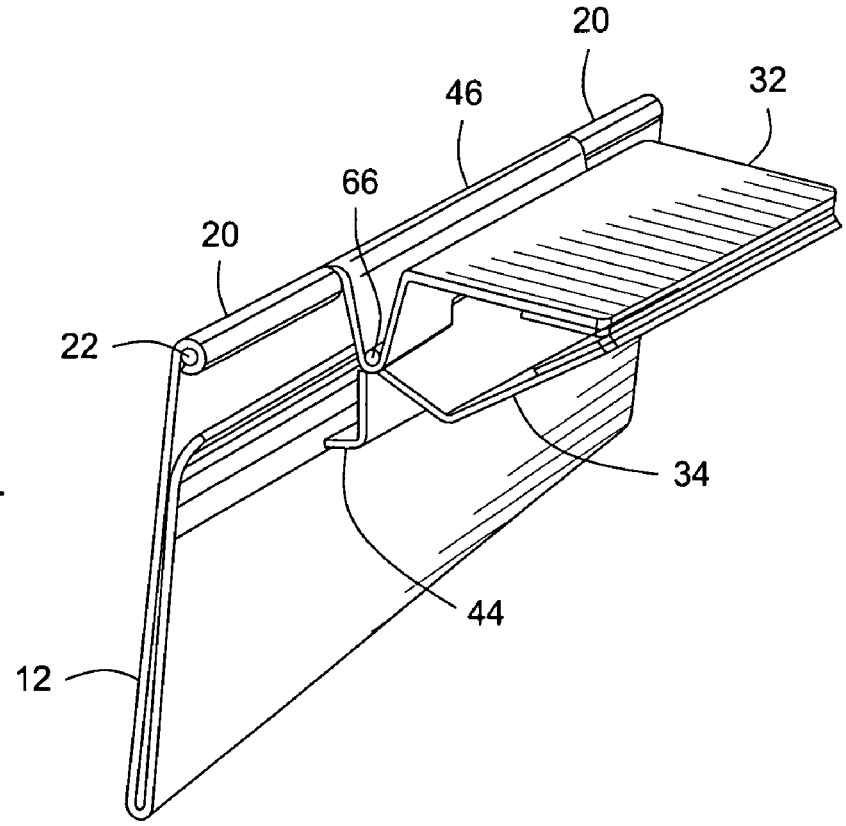
FIG. 4 is a rear perspective view of the book shelf display device of FIG. 1, the clip mechanism shown in the fully closed, non-engaged position.

Clip mechanism 30 will now be described with particular reference to FIGS. 3, 4 and 5. Clip mechanism 30 generally comprises two mating clamshell like clamping members 32 and 34, having inner gripping surfaces 38 and 36 respectively. Each of clamping members 32 and 34 includes a humped portion, defined in part by walls 40 and 42, which with members 32 and 34 positioned in interlocking relationship, define a channel through which a bar 66 can be inserted. Member 34 at its one end terminates at flanged end 44, and at its other end at leading edge 45. Member 32 at its one end terminates at tubular wall 46 and at its other end at leading edge 47. Springs 60, wound about bar 66 are biased such as to close clip mechanism 30, as shown in FIG. 4, bringing leading edges 45 and 47 together when the clip is in the fully closed, non-engaged position.

Surfaces 36 and 38 are generally of rectangular plan, and disposed generally parallel to one another as shown in the figures when the clip is mounted to the leading edge of a book shelf. The length of members 32 and 34 relative to the length of display section 10 is not critical. In the illustrated embodiment it is somewhat more than half of the distance. The depth of members 32 and 34 is likewise not critical, though it should be sufficient to securely engage with the book shelf to which it is to be attached. In one embodiment, the depth of the clamps can be extended a defined distance such that leading edge 47 will most likely rest beneath the leading edge of the book with which it is to be associated.

Pads 50 are provided at leading edges 45 and 47 of clamping members 32 and 34 to provide gripping surfaces. In one embodiment, the pads are formed of a relatively soft rubber-like material. In another embodiment, the rubber like material is silicon based. In a still further embodiment the silicon material may cover surfaces 36 and 38 in their entirety.

Display portion 10 is connected to clip mechanism 30 through a hinged connection disposed to the top of portion 10. As illustrated in the figures, at its top face 12 turns in onto itself to define tubular sections 20, said tubular sections accommodating therebetween tubular section 46 of clip mechanism 30. When aligned as shown, sections 20 and 46 define an elongate cylindrical channel which receives bar 22, the bar sized to run the length of the channel, fitting securely inside, while at the same time allowing for the free pivoting of display portion 10 about its hinged connection.

In an embodiment of the invention, bar 22 can be sized at one end to extend a short distance beyond the edge of tubular section 20 of display portion 10, and bent, such as at a right angle, to provide a "handle" by which bar 22 may be readily gripped and removed from the cylindrical channel in which it is set. In this manner, by removing bar 22, display portion 10 may be easily separated from clip mechanism 30. One might wish to do this, by way of example to replace a damaged display portion, or to replace a display portion which one of another color, size, or the like. With the replacement display portion in place, bar 22 can then be reinserted, and the unit redeployed.

Figure 5:
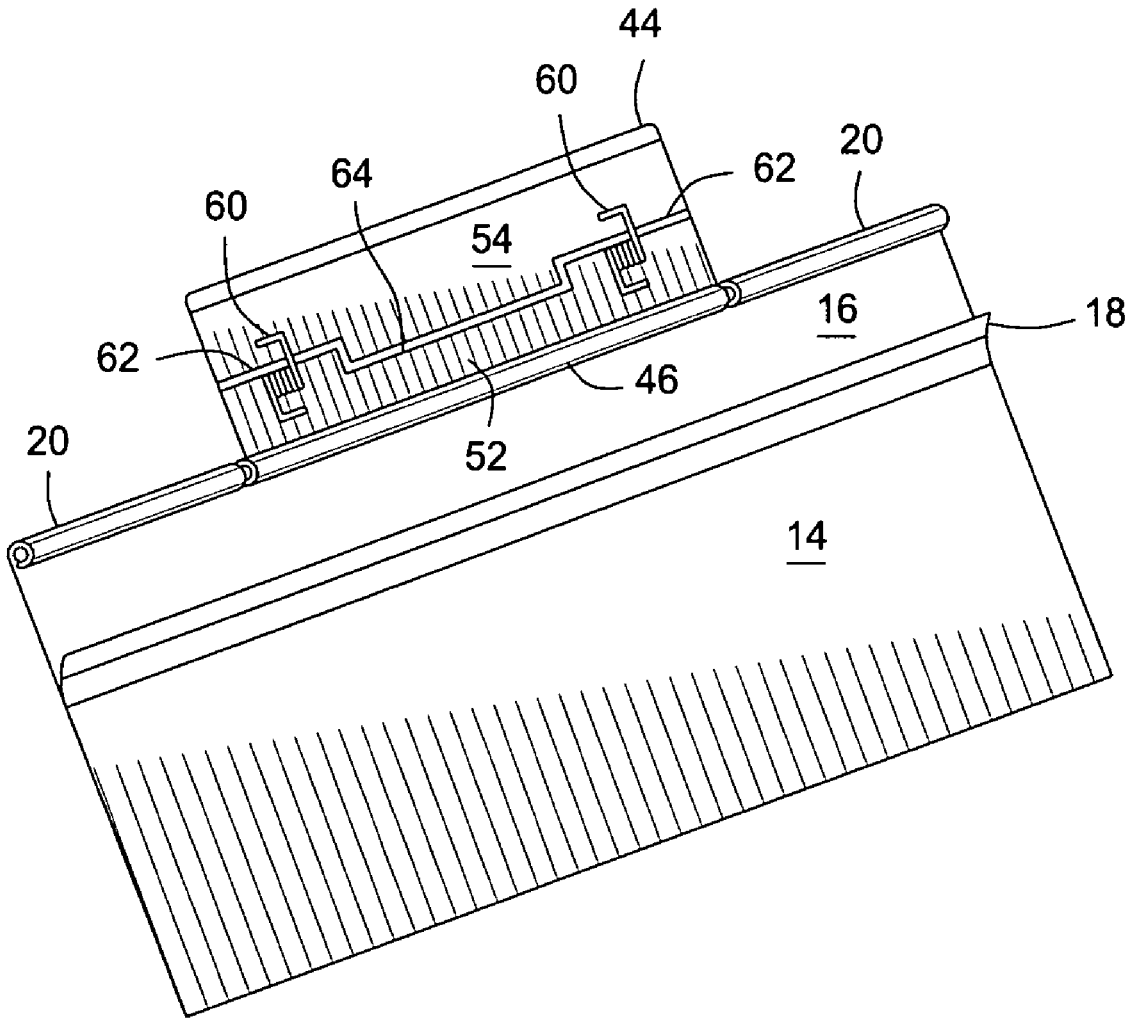
FIG. 5 is a plan view of the device with the display portion rotated 180 degrees to expose the back spine of the clip mechanism.

With reference to FIG. 5, the book shelf display device is shown with display portion 10 rotated 180 degrees to reveal backside surface 52 of clamping member 32, backside surface 54 of clamping member 34, and springs 60. The two clamping members are hingedly joined together in a fashion similar to the hinged arrangement used to connect display portion 10 to clip mechanism 30. As shown in the figures, a section 62 is cut away at each end from the ridge of the humped section of clamping member 34. A corresponding central section 64 is cut away from the ridge of humped section of clamping member 32, the radius of the humped sections selected so as to define a tubular passageway for engagement of bar 66 when the two clamping members are brought into engaged relationship.

To position the display clip of this invention, the document to be displayed is placed within the plastic pocket of display portion 10 formed by walls 12 and 14. Clip 30 is then grasped, such as along ridge 46 and flanged end 44, and pressure applied against the countervailing force of the springs to spread the clamping members. In this manner the clamping members rotate about their hinged connection, and are spread apart a distance greater than the thickness of the book shelf to which the clip is to be attached. So spread, the clamping members are brought into position above and below the top and bottom surfaces of the bookshelf and allowed to close over and grip the shelf. In one embodiment, the clip can be brought forward until vertical sections 40 and 42 of clamping members 32 and 34 engage the edge of the shelf. So positioned, display portion 10 can freely hang in the vertical position, and is easily be rotated out of the way when removing a book from a bookshelf situated immediately below.

In an embodiment, the display portion can be made of clear plastic. In another embodiment, it can be made of tinted though transparent plastic. Further the back wall of the display portion need not itself be transparent, but for ease of fabrication it is formed of the same material as the front face of the display. In yet another embodiment, the length of clamping member flange 44 can be adjusted to change the angle at which the display disposes when mounted. As shown in FIG. 3, display 10 is shown hanging downwardly a few degrees off true vertical. By shortening flange 44, the display angle can be brought closer to vertical. Conversely, extending it can move the display angle further away.

In still another embodiment, leading edge 47 of clamping member 32 can be beveled so as to reduce the likelihood of catching the bottom edge of a book proximate to the display device, as it is removed from the shelf. Constraints include not making the beveled edge so thin as to constitute a safety hazard, or to be readily susceptible to breaking or cracking. As previously noted, the extent of the clamp can also be increased such that the leading edge will be positioned further back of the book shelf, thus increasing the likelihood that this edge will be positioned underneath the flagged book, beyond its leading edge. Without departing from the scope and spirit of this invention, it is possible to modify the display device for use with shelves in which channels are provided at the ends of a shelf for insertion of a tag, such as of the type commonly encountered in grocery stores. For example, such shelves are provided with a rail at their edge said rail having upper and lower portions which are turned in to define a shallow channel running the length of the leading edge of the shelf rail. The tag is inserted by flexing so that the edges are placed between the channels; the tag then allowed to relax, whereby its edges become engaged in said channels.

Similarly, for the display device of this invention, the leading edges of clamping members 32 and 34 can be turned outward 90 degrees, and the clamping member be spring biased to the open position. In this manner the device can be positioned with the leading edges of the clamping members closed together and placed proximate to the channels of the shelf rail; the member then allowed to return to its biased, open position such that the end of the clamping members spread apart and become securely set within the channels of the rails.

While the foregoing is directed to embodiments of the present invention, other and further embodiments of the invention may be devised without departing from the basic scope thereof, and the scope thereof is determined by the claims that follow.

The invention claimed is:

1. A display device configured to be attached to the end of a shelf comprising:

a display portion having a transparent face, said display portion further defining a pocket for receiving a document to be displayed;

a clip mechanism including two opposing clamping members, connected by a hinge to one another, and including at least one spring to bias the clamping members to the closed position, the clamping members so configured, such that when they are spread apart to engage the edge of a shelf, the flat faces of the clamping members are brought into generally parallel opposition;

said display portion removeably connected by a hinge to said clip mechanism, such that when said clamping members are in the engaged position with the end of a shelf, the display portion is free to rotate about said hinge and hang downwardly in a generally vertical position, wherein said hinge comprises an elongate cylindrical channel which a receives bar, the bar sized to run the length of the cylindrical channel, fitting securely inside, while at the same time allowing for the free rotation of display portion about its hinged connection to said clip mechanism, such that the display portion can be rotated upwardly beyond the vertical position so that it remains in said upwardly rotated position until turned down.

2. The display device of claim 1 wherein the display portion is of a generally rectangular configuration.

3. The display device of claim 1 wherein the display portion further includes a back wall which at its leading edge is in movable contact with the back surface of the said transparent face.

4. The display device of claim 3 wherein the back wall of the display portion is of the same overall width as the transparent face of the display portion and of a lesser height, to expose a portion of the back wall of said transparent face.

5. The display device of claim 1 further including a soft rubber-like material applied to the inside surface of each of said clamping members.

6. The display device of claim 5 wherein said soft rubber like material is in the form of a flat pad disposed along the leading edge of said clamping members.

7. A display device configured to be attached to the edge of a shelf comprising:

a display portion having a transparent face, said display portion further defining a pocket for receiving a document to be displayed;

a clip mechanism including two opposing clamping members, hingedly connected to one another, and including at least one spring;

said display portion hingedly connected to said clip mechanism, said hinge comprising a plurality of looped channels which, when in alignment one with the other define, a tubular space, and a pin sized to be inserted into said tubular space to hingedly connecting said display portion with said clip mechanism, permitting free rotation of said display portion about said hinge, such that when said clamping members are in the engaged position with the edge of a shelf, the display is free to rotate about said hinge and hang downwardly in a generally vertical position.

8. The display device of claim 7 wherein the spring is biased to the closed position.

9. The display device of claim 7 wherein the free ends of clamping members are turned outwardly 90 degrees, and said spring is biased to the open position.

* * * * *